US007322809B2

(12) United States Patent
Kitaura et al.

(10) Patent No.: US 7,322,809 B2
(45) Date of Patent: Jan. 29, 2008

(54) ROTARY COMPRESSOR WITH SEALING PORTIONS AND OIL-SUPPLY GROOVE

(75) Inventors: Hiroshi Kitaura, Sakai (JP); Hiroyuki Yamaji, Sakai (JP); Masanori Yanagisawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/490,164

(22) PCT Filed: Apr. 16, 2003

(86) PCT No.: PCT/JP03/04863

§ 371 (c)(1),
(2), (4) Date: Mar. 18, 2004

(87) PCT Pub. No.: WO03/104657

PCT Pub. Date: Dec. 18, 2003

(65) Prior Publication Data

US 2004/0247474 A1 Dec. 9, 2004

(30) Foreign Application Priority Data

Jun. 5, 2002 (JP) ..... 2002-163842

(51) Int. Cl.
*F04C 2/00* (2006.01)
*F03C 2/00* (2006.01)

(52) U.S. Cl. ..... 418/94; 418/55.1; 418/55.4; 418/55.6; 184/6.18

(58) Field of Classification Search ..... 418/57, 418/88, 94, 55.1–55.6; 184/6.16, 6.18
See application file for complete search history.

(56) References Cited

U.S. PATENT DOCUMENTS

| | | | | |
|---|---|---|---|---|
| 902,831 | A * | 11/1908 | Petersen | 384/392 |
| 3,451,615 | A | 6/1969 | Hover | |
| 4,496,296 | A * | 1/1985 | Arai et al. | 418/55.5 |
| 4,596,521 | A * | 6/1986 | Murayama et al. | 418/55.6 |
| 4,749,344 | A * | 6/1988 | Tomita et al. | 418/55.6 |
| RE33,236 | E * | 6/1990 | Hazaki et al. | 418/55.5 |
| 4,997,350 | A * | 3/1991 | Tamura et al. | 418/55.6 |
| 5,660,539 | A * | 8/1997 | Matsunaga et al. | 418/55.5 |
| 6,135,738 | A * | 10/2000 | Kajiwara et al. | 418/94 |
| 6,354,822 | B1 * | 3/2002 | Lifson et al. | 418/55.6 |

FOREIGN PATENT DOCUMENTS

| | | |
|---|---|---|
| JP | 63-115590 U | 7/1988 |
| JP | 02-39590 U | 3/1990 |
| JP | 06-173954 A | 6/1994 |
| JP | 08-261177 A | 10/1996 |

(Continued)

*Primary Examiner*—Theresa Trieu
(74) *Attorney, Agent, or Firm*—Global IP Counselors

(57) ABSTRACT

In a rotary compressor to perform oil supplying to bearings through a main oil-supply passage formed in a drive shaft by making use of pressure differential between high-level pressure and low-level pressure in the casing, sealing portions having air-tight structures are formed at both sides in the axis direction of each of the sliding faces constituted between the drive shaft and the bearings, putting bearing-portion oil-supply passages between the sealing portions, to improve the reliability of the bearings by preventing high-pressure gas flowing into a portion between the drive shaft and the bearings.

13 Claims, 4 Drawing Sheets

FOREIGN PATENT DOCUMENTS

| | | | |
|---|---|---|---|
| JP | 10-236486 | A | 9/1998 |
| JP | 10-288178 | A | 10/1998 |
| JP | 11-22665 | | 1/1999 |
| JP | 2000-27782 | A | 1/2000 |
| JP | 2001-041162 | A | 2/2001 |

* cited by examiner

ROTARY COMPRESSOR WITH SEALING PORTIONS AND OIL-SUPPLY GROOVE

TECHNICAL FIELD

The present invention relates to a rotary compressor such as a scroll compressor, and particularly to bearing structure for a drive shaft.

BACKGROUND ART

Conventionally, a scroll compressor as an example of a rotary compressor to compress a gas refrigerant in a refrigerating cycle has been used. The scroll compressor includes a fixed scroll and an orbiting scroll that have involute wraps engaged with each other in a casing. The fixed scroll is fixed in the casing and the orbiting scroll is coupled to an eccentric portion of a drive shaft (crank shaft). Further, the drive shaft is supported at the casing through a bearing. In the scroll compressor, the orbiting scroll just revolves orbitally to the fixed scroll without rotating on its own axis, thereby contracting a compression chamber formed between the wraps of both scrolls to compress a gas such as the refrigerant.

In general, such scroll compressor adopts lubricating structure in which a refrigerating machine oil collected in an oil reservoir in the casing is supplied to a sliding surface constituted between the both scrolls, a sliding face Constituted between the drive shaft and the bearing and the like through a main oil-supply passage formed in the drive shaft. For example, certain structure is disclosed in Japanese Laid-Open Patent Publication No. 8-261177, in which an oil reservoir is formed at a portion in a casing whose pressure is high, and a sliding surface constituted between both scrolls is connected to a suction side of a compressing mechanism so as to make the sliding surface a relatively low pressure, so that a refrigerating machine oil is supplied to the above sliding surface by pressure-differential pump structure that makes use of pressure differential between high-level pressure and low-level pressure.

Further, in the scroll compressor disclosed in the above publication, a bearing-portion oil-supply passage is formed in a drive shaft, which branches off from a main oil-supply passage and then connects with a sliding face constituted between the drive shaft and the bearing, and a spiral groove is formed at an inner peripheral face of the bearing, so that the refrigerating machine oil in the main oil-supply passage is supplied to the above sliding face. This spiral groove is open to high-pressure space in the casing at the both end portions in the axis direction of the bearing. In this case, the refrigerating machine oil that has lubricated the sliding face flows out of the spiral groove and then returns to the oil reservoir through the space in the casing.

-Problem to be Solved-

The above-described structure, however, is capable of supplying the refrigerating machine oil to the sliding surface at the both scrolls and the sliding surface of the bearing by the pressure-differential pump function during its ordinary operation, but there is some possibility that lubrication of the sliding face at the bearing may become insufficient during its starting operation. The reason for this is considered as the following. That is, during the starting operation of compressor, the gas refrigerant providing high-pressure atmosphere in the casing flows back in the spiral groove toward the main oil-supply passage before the refrigerating machine oil in the oil reservoir is supplied to the sliding surface at the both scrolls by the pressure-differential pump function. Thereby, it becomes difficult to supply the refrigerating machine oil in the oil reservoir to the sliding face at the bearing, and the oil remaining at the sliding face during a halt of the operation is forced to flow back to the main oil-supply passage. Accordingly, the temperature of the bearing tends to rise excessively for lack of lubrication, and repeating of this state may deteriorate the reliability of bearing, and in some cases, this may cause seizure of drive shaft.

The present invention has been devised in view of the above problem, and an object of the present invention is to improve the reliability of bearing, in the rotary compressor that adopts oil supplying to bearing by the pressure-differential pump, by preventing gas flowing into a portion between the drive shaft and the bearing.

DISCLOSURE OF THE INVENTION

In order to achieve the above object, the present invention comprises sealing portions (65) having air-tight structure, which are formed at the both sides in the axis direction of a sliding face at a bearing portion of a rotary compressor, thereby preventing a gas from flowing into the sliding face.

Specifically, in a first aspect of the present invention the present invention defined in claim 1 provides a rotary compressor including a compressing mechanism (15) and a compressor motor (16) with a drive shaft (17) driving the compressing mechanism (15) that are disposed in a casing (10) thereof, the drive shaft (17) is supported by a bearing (32,34,45) that is disposed in a high-pressure space in the casing (10), the drive shaft (17) having a main oil-supply passage (51) and a bearing-portion oil-supply passage (59, 60,61) that are formed therein, the main oil-supply passage (51) connecting an oil reservoir (48) whose inside pressure increases during its operation with a low-pressure space (37*a*), one end of the bearing-portion oil-supply passage (59,60,61) is connected with the main oil-supply passage (51), the other end of the bearing-portion oil-supply passage (59,60,61) is connected with a sliding face constituted between the drive shaft (17) and the bearing (32,34,45).

Herein, the rotary compressor according to the present invention defined in the first aspect further comprises sealing portions (65) having substantially air-tight structures, which are formed at both sides in the axis direction of the sliding face constituted between the drive shaft (17) and the bearing (32,34,45), putting the bearing-portion oil-supply passage (59,60,61) between the sealing portions (65). The sealing portion (65) can be actualized by controlling the outside diameter of the drive shaft (17) and the inside diameter of the bearing (32,34,45) so accurately, for example, such as at a micron order that there exists substantially no gap between them.

According to this structure, during ordinary operation of the compressor, oil flows into the low-pressure space (37*a*) through the main oil-supply passage (51) due to high-pressure acting on the oil reservoir (48). This oil flows down in the bearing-portion oil-supply passage (59,60,61) that branches off from the main oil-supply passage (51), and is also supplied to the bearing (32,34,45). Thus, the sliding face constituted between the drive shaft (17) and the bearing (32,34,45) is lubricated.

Meanwhile, during starting operation of the compressor, when pressure in the casing (10) rises due to a high-pressure gas such as the refrigerant, the high pressure acts on the oil reservoir (48) and then the oil in the oil reservoir (48) flows into the main oil-supply passage (51). At this time, although the gas pressure in the casing (10) acts between the drive shaft (17) and the bearing (32,34,45), high-pressure gas does not flow into the sliding face because the sealing portion (65) having air-tight structure is formed at the both sides in the axis direction of the sliding face. Accordingly, because the oil in the oil reservoir (48) is not prevented from being supplied to the sliding face and the oil remaining at the sliding face is not forced to flow back to the main oil-supply passage (51), no lack of lubrication occurs.

Further, in a second aspect of the present invention the present invention provides the rotary compressor of of the first aspect, wherein the compressing mechanism (15) comprises a fixed scroll (22) that is fixed in the casing (10) and an orbiting scroll (26) that revolves orbitally to the fixed scroll (22), and the orbiting scroll (26) comprises a scroll-portion oil-supply passage (53) that is formed so as to be connected from the main oil-supply passage (51) of the drive shaft (17) to the low-pressure space (37*a*) located at a suction side of the compressing mechanism (15) through a sliding surface constituted between the fixed scroll (22) and the orbiting scroll (26). Namely, the present invention defined in the second aspect is constituted such that the rotary compressor is limited to the scroll compressor, in which the oil reservoir (48) is connected with the suction side of the compressing mechanism (15) and the oil is supplied to the sliding faces at the scrolls (22,26) and the bearing (32,34,45) by the pressure-deferential pump function.

According to this structure, the oil flowing in the main oil-supply passage (51) is supplied to the sliding face constituted between the drive shaft (17) and the bearing (32,34,45) and also to the sliding surface constituted between the fixed scroll (22) and the orbiting scroll (26) due to pressure differential between high pressure of the oil reservoir (48) and low pressure at the suction side of the compressing mechanism (15), thereby lubricating the both sliding faces.

Further, in a third aspect of the present invention, the present invention provides the rotary compressor of the second aspect, wherein at least part of the scroll-portion oil-supply passage (53) is constituted of a restriction pathway (56).

According to this structure, even though a gap occurs at the sliding surface between the both scrolls (22,26) when gas pressure in the compression chamber rises excessively and the orbiting scroll (26) inclines (overturn) during revolution of the orbiting scroll (26), the restriction function of the scroll-portion oil-supply passage (53) prevents the refrigerating machine oil from leaking out of the gap between the fixed scroll (22) and the orbiting scroll (26). Thus, although leaking of lots of oil out of the sliding surface may bring about decreasing of the amount of oil to be supplied to the bearing (32,34,45), the above prevention of oil leaking can prevent the amount of oil to be supplied to the bearing-portion oil-supply passage (59,60,61) from decreasing.

Further, in a fourth aspect of the present invention, the present invention provides the rotary compressor of any one of the preceding aspects, wherein at least either one of the drive shaft (17) and the bearing (32,34,45) comprises an oil supply groove (64), the oil supply groove (64) is formed at the sliding face constituted between the drive shaft (17) and the bearing (32,34,45) and between the sealing portions (65) disposed on either side of the bearing-portion oil-supply passage (59,60,61) in the axis direction, and the oil supply groove (64) is connected to the bearing-portion oil-supply passage (59,60,61).

According to this structure, the oil that is supplied to the above sliding face from the main oil-supply passage (51) through the bearing-portion oil-supply passage (59,60,61) once flows into the oil supply groove (64) and then it spreads over the sliding face with rotation of the drive shaft (17), thereby lubricating the sliding face. Meanwhile, during the starting operation, the oil remaining at the sliding face and the oil staying in the oil supply groove (64) spreads over the sliding face, thereby lubricating the sliding face.

Further, in a fifth aspect of the present invention the present invention provides the rotary compressor of the fourth aspect, wherein the drive shaft (17) is disposed so as to extend in the vertical direction in the casing (10), the bearing (32,34,45) comprises a lower bearing (45) that is close to the oil reservoir (48) and an upper bearing (32,34) that is located above the lower bearing (45), and the oil supply groove (64) formed at the sliding face is disposed at least at the upper bearing (32,34).

According to this structure, it can lubricate uniformly over the sliding face of the bearing (32,34) with the oil through the oil supply groove (64) formed at the sliding face during both the ordinary operation and the starting operation. Further, disposing the lower bearing (45) close to the oil reservoir (48) can make use of the oil collected in it for lubricating. Particularly, during the starting operation the refrigerating machine oil returns to the oil reservoir (48) and an oil level of the oil reservoir (48) goes up, resulting in making use of the oil reservoir (48) in the oil reservoir (48) effectively.

Further, in a sixth aspect of the present invention, the present invention provides the rotary compressor of the fourth aspect, wherein a length: L of the bearing (32,34) in the axis direction, a gap distance: C between the inside diameter of the bearing (32,34) and the outside diameter of the drive shaft (17) at the sliding face, and a length: b of the oil groove (64) in the axis direction are provided so as to satisfy the following equation (3):

$$0.3L<b<L-0.2C\times10^3 \quad (3).$$

The equation (3) is determined by substituting the following equation (2) for the following equation (1) so that both equations can be satisfied:

$$((L-b)/C)\times10^{-3}>0.2 \quad (1)$$

$$b/L>0.3 \quad (2).$$

Herein, the value of the equation (1): $((L-b)/C)\times10^{-3}$ indicates a ratio of a length in the axis direction of the sealing portion (65) to a width of the gap between the drive shaft (17) and the bearing (32,34). When the value is 0.2 or less, the gas volume flowing into the sliding face increases sharply, thereby deteriorating the sealing function. On the other hand, when the value is more than 0.2, the flowing gas volume can be suppressed (see FIG. 4).

Further, when the ratio indicated by b/L in the equation (2) is 0.3 or less, the temperature of the bearing (32,34) increases sharply. When the ratio is more than 0.3, the temperature increasing of the bearing (32,34) can be suppressed (see FIG. 5).

Also, when the equation (3) determined by substituting the equation (2) for the equation (1) is satisfied, the both functions of the equations (1), (2) can be performed. Accordingly, this structure can suppress the gas volume flowing into the sliding face between the drive shaft (17) and the bearing (32,34) and also the temperature increasing of the bearing (32,34) as well.

-Effect-

According to the present invention defined in the first aspect, the sealing portions (65) having substantially air-tight structures are formed at both sides in the axis direction of the sliding face constituted between the drive shaft (17) and the bearing (32,34,45), putting the bearing-portion oil-supply passage (59,60,61) extending from the main oil-supply passage (51) between the sealing portions (65), so that the gas can not flow into the sliding face between the drive shaft (17) and the bearing (32,34,45) even during the starting operation. Thus, excessive temperature increasing due to the lack of lubrication of the sliding face can be prevented. Accordingly, deterioration of the reliability of the bearing (32,34,45) can be prevented and the possibility of seizure can be also eliminated.

Further, according to the present invention defined in the second aspect, in the scroll compressor, in which the oil in the oil reservoir (48) is supplied to the sliding surface between the fixed scroll (22) and the orbiting scroll (26) by the pressure-differential pump function, the lubrication of the sliding face at the bearing portion can be performed by making use of the pressure-differential pump, and the lack of lubrication during the starting operation can be prevented. Particularly, the scroll compressor provides the restriction effect at the sliding surface of both scrolls (22,26), and thereby the refrigerating machine oil can be supplied to the sliding face certainly.

Further, according to the present invention defined in the third aspect, providing the scroll-portion oil-supply passage (53) with the restriction function can prevent the oil leakage from the sliding surface even if the orbiting scroll (26) inclines (overturn) due to increasing of the inner pressure in the compression chamber, thereby achieving certain oil supplying to the sliding face at the bearing (32,34,45).

Further, according to the present invention defined in the fourth aspect, forming the oil supply groove (64) between the sealing portions (65) disposed on either side of the sliding face in the axis direction can improve the lubricating effect with oil spreading over an entire of the sliding face easily and lubricate the sliding face effectively by also making use of the oil remaining at the oil supply groove (64) during the starting operation. Forming the oil supply groove (64) at every bearing (32,34,45) of the drive shaft (17) can improve the reliability of lubrication.

Meanwhile, according to the present invention defined in the fifth aspect, forming the oil supply groove (64) at the sliding face at the side of the upper bearing (32,34) provides certain lubrication, while the lubrication is performed by making use of the oil in the oil reservoir (48), without forming the oil supply groove (64) at the lower bearing (45). Accordingly, it can simplify the structure compared with the one in which the oil supply groove (64) is formed at every portion. Further, because the bearing (45) without the oil supply groove (64) is limited to the lower bearing (45) that is located close to the oil reservoir (48), the lack of lubrication at the sliding face can be prevented.

Further, according to the present invention defined in the sixth aspect, determining dimensions of the oil supply groove (64) so as to satisfy the equation (3), $0.3L<b<L-0.2C\times10^3$, can prevent certainly the gas from flowing into the bearing (32,34), thereby improving the performance of the bearing and preventing the deterioration of durability due to temperature increasing of the bearing (32,34).

That is, satisfying the equation (1), $((L-b)/C)\times10^{-3}>0.2$, can prevent certainly the gas from flowing into the bearing (32,34), and particularly improve the performance of bearing during the starting operation. Also, satisfying the equation (2), $b/L>0.3$, can suppress certainly temperature increasing of the bearing (32,34), thereby maintaining the durability of the baring (32,34).

BEST MODE FOR CARRING OUT THE INVENTION

An embodiment of the present invention will be described with reference to the accompanying drawings. The present embodiment relates to a scroll compressor. The scroll compressor compresses a gas refrigerant, being connected to a refrigerating circuit, not shown in any drawing, which performs refrigerating-cycle operation with the gas refrigerant circulated therein.

Figure 1:
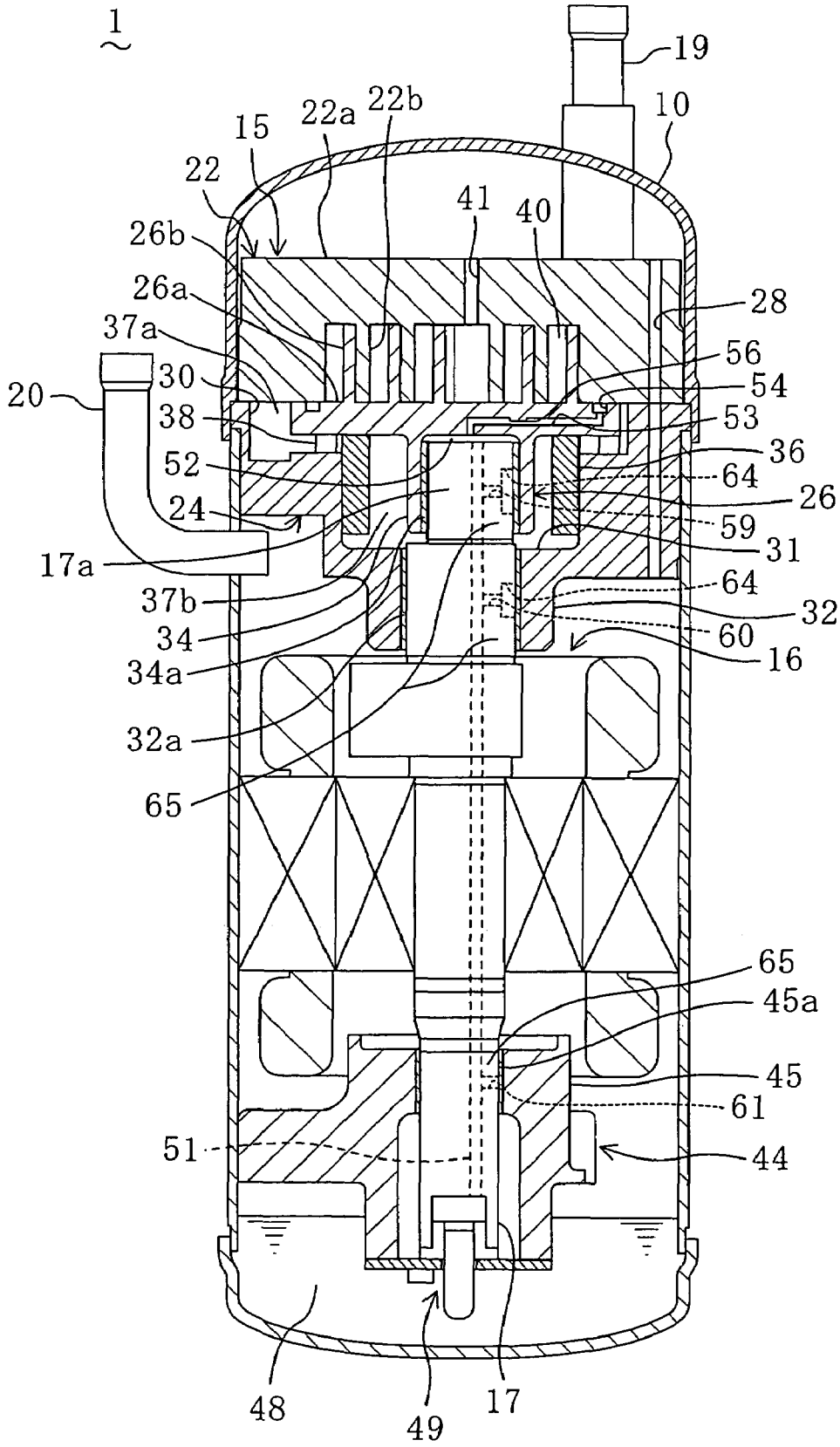
FIG. 1 is a sectional view for showing an entire structure of a scroll compressor according to an embodiment of the present invention.

As shown in FIG. 1, the scroll compressor (1) includes a casing (10) constituted of a sealed dome-type pressure vessel with a longitudinal-cylinder shape. In the casing (10), a compressing mechanism (15) to compress the gas refrigerant and a compressor motor (16) to drive the compressing mechanism (15) are installed. The compressor motor (16) is disposed below the compressing mechanism (15). The compressor motor (16) includes a drive shaft (17) to drive the compressing mechanism (15), and the drive shaft (17) is coupled to the compressing mechanism (15).

The compressing mechanism (15) includes a fixed scroll (22), a frame (24) disposed so as to contact to the lower face of the fixed scroll (22) closely, and an orbiting scroll (26) engaged with the fixed scroll (22). The frame (24) has an air-tight connection with the casing (10) at its entire periphery. A connecting passage (28) is formed at the fixed scroll (22) and the frame (24), penetrating them vertically.

The frame (24) is provided with a frame recess (30) formed at the upper face thereof, a center recess (31) formed at the bottom face of the frame recess (30), and an upper-first bearing (32) disposed at the center of the lower face thereof. The upper-first bearing (32) supports the drive shaft (17) through a slide bearing (32*a*) so that the drive shaft (17) can rotate freely therein.

A suction pipe (19) to introduce the refrigerant of the refrigerating circuit into the compressing mechanism (15) and a discharge pipe (20) to discharge the refrigerant in the casing (10) out of the casing (10) are coupled to the casing (10) respectively with air-tight connections.

The fixed scroll (22) and the orbiting scroll (26) include respectively end plates (22*a*,26*a*) and involute wraps (22*b*, 26*b*). At the lower face of the end plate (26*a*) of the orbiting scroll (26), an upper-second bearing (34) that is located inside the frame recess (30) and the center recess (31) and coupled to the drive shaft (17) is provided. A ring-shape seal ring (36) is disposed outside the upper-second bearing (34) so as to fit into the inner peripheral face of the center recess (31).

The inside of the frame recess (30) and the center recess (31) is divided into first space (37*a*) disposed outside the seal ring (36) and second space (37*b*) disposed inside the seal ring (36), by the seal ring (36) that is pressed and contacted closely to the orbiting scroll (26) by spring means (not shown in any drawing), such as a plate spring. The frame (24) is provided with an oil-return hole (not shown in any drawing), and the second space (37*b*) is connected to the lower space below the frame (24). Thereby, when flowing into the second space (37*b*), the refrigerating machine oil is retuned to the lower space below the frame (24).

An eccentric shaft portion (17*a*) at the upper end of the drive shaft (17) is inserted in the upper-second bearing (34) of the orbiting scroll (26) through a slide bearing (34*a*). Meanwhile, the orbiting scroll (26) is coupled to the frame (24) through an Oldham ring (38) so as to revolve orbitally in the frame (24) without rotating on its own axis. The lower face of the end plate (22*a*) of the fixed scroll (22) and the upper face of the end plate (26*a*) of the orbiting scroll (26) constitute a sliding surface for both faces contacting to and sliding on each other, and a gap between contacting portions of the wraps (22*b*,26*b*) of both scrolls (22,26) is formed as a compression chamber (40).

A discharge hole (41) to connect the compression chamber (40) with the upper space of the fixed scroll (22) is formed at the center of the fixed scroll (22). Herein, when the compression chamber (40) is contracted toward the center by the revolution of the orbiting scroll (26) and thereby the gas refrigerant is compressed, the gas refrigerant compressed in the compression chamber (40) flows into the upper space above the frame (24) through the discharge hole (41) and further flows into the lower space below the frame (24) through a connecting passage (28). Accordingly, the inside of the casing (10) becomes high-pressure space where the discharged gas refrigerant with high pressure is filled, and the above second space (37*b*) becomes high-pressure space as well.

A lower frame (44) fixed to the casing (10), which is provided below the above compressor motor (16), includes a lower bearing (45) that supports a lower pat of the drive shaft (17) through a slide bearing (45*a*) so that the drive shaft (17) can rotate freely therein.

The casing (10) is provided with an oil reservoir (48) at the bottom thereof, and a centrifugal pump (49) is disposed at the lower end of the drive shaft (17) to pump up the oil in the oil reservoir (48) by rotation of the drive shaft (17). Part of the lower frame (44) is put into the oil in the oil reservoir (48).

A main oil-supply passage (51) is formed in the drive shaft (17), in which oil pumped up by the centrifugal pump (49) flows. The main oil-supply passage (51) is formed at a position that is eccentric from and parallel to the axis of the drive shaft (17). Further, an oil chamber (52) is formed between the drive shaft (17) and the end plate (26*a*) in the upper-second bearing (34) of the orbiting scroll (26), and the oil flowing into the main oil-supply passage (51) is supplied to respective sling faces constituted between the drive shaft (17) and bearings (32,34,45) and also to the oil chamber (52).

As described above, the refrigerating machine oil with high pressure is supplied to the oil chamber (52) in the upper-second bearing (34) of the orbiting scroll (26), and further the second space (37*b*) is filled with the gas refrigerant with high pressure. Accordingly, a force for pressing the orbital scroll (26) against the fixed scroll (22) in the axis direction is produced by making use of each pressure of the refrigerating machine oil and the gas refrigerant.

Meanwhile, a scroll-portion oil-supply passage (53) extending in the radius direction is formed at the end plate (26*a*) of the orbital scroll (26). The scroll-portion oil-supply passage (53) is formed such that it extends in the radius direction inside the end plate (26*a*), and its inner end is connected to the oil chamber (52), while its outer end is connected to an oil groove (54) that is formed at the upper face of the end plate (26*a*), for example, in a circumferential ring shape. A suction side portion (peripheral-edge side portions at the gap between contact portions of wraps (22*b*,26*b*)) of the compression chamber (40), which constitutes low-pressure space, is connected to the above first space (37*a*) through a thin groove (not shown in any drawing) formed at the sliding surface between the both scrolls (22,26). Accordingly, during the operation of the compressor (1), the pressure of the sliding surface is relatively low compared to the high-pressure space in the casing (10), thereby producing pressure differential between them.

That is, the main oil-supply passage (51) at the drive shaft (17) connects the oil reservoir (48), which becomes high pressure during the operation, with the first space (37*a*), which is low-pressure space, through the above scroll-portion oil-supply passage (53). Accordingly, receiving the pump function by pressure differential between high-level pressure and low-level pressure and the function by the above centrifugal pump, the refrigerating machine oil in the oil reservoir (48) goes up in the main oil-supply passage (51) from the oil reservoir (48), and is supplied to the sliding surface between the both scrolls (22,26) through the oil chamber (52) and the scroll-portion oil-supply passage (53).

A restriction (56) having a narrow flowing area is formed at part of the scroll-portion oil-supply passage (53). The restriction (56) can be made by, instead of making a partial flowing area of the passage (53) narrow, providing the passage (53) having a small diameter along the entire length thereof, and this may improve workability more.

Bearing-portion oil-supply passages (59,60,61) are formed in the drive shaft (17), whose each one end is connected with the main oil-supply passage (51) and each other end is connected with each sliding face between the drive shaft (17) and bearings (32,34,45). As these bearing-portion oil-supply passages (59,60,61), a first bearing-portion oil-supply passage (59) that opens at the upper-second bearing (34) formed at the orbiting scroll (26), a second bearing-portion oil-supply passage (60) that opens at the upper-first bearing (32) formed at the frame (24), and a third bearing-portion oil-supply passage (61) that opens at the lower-portion bearing (45) formed at the lower frame (44) are respectively formed in the drive shaft (17).

Each of the bearing-portion oil-supply passages (59,60, 61) opens at each of sliding faces between the drive shaft (17) and the bearing (34,32,45), and each opening is located at the center portion in the axis direction of each of the sliding faces. Furthermore, sealing portions (65) include first, second, third and fourth sealing portions (65*a*,65*b*,65*c*, 65*d*). The outer peripheral face of the drive shaft (17) and the inner peripheral face of the bearing (34) form the first and second sealing portions (65*a*, 65*b*) having substantially air-tight structures. The first sealing portion (65*a*) is located on a side of the bearing-portion oil-supply passage (59) at a first interface portion between the drive shaft (17) and the bearing (34) and the second sealing portion (65*b*) is located on an opposite side of the bearing-portion oil-supply passage (59) in an axial direction of the sliding face at a second interface portion between the drive shaft (17) and the same bearing (34). In addition, the drive shaft (17) and an additional bearing-portion oil-supply passage (60) with an additional bearing (32) have an inner peripheral face disposed about the outer peripheral face of the drive shaft (17) such that the inner peripheral face of the additional bearing (32) and the outer peripheral face of the drive shaft (17) form the third and fourth sealing portions (65*c*,65*d*) having substantially air-tight structures. The third sealing portion (65*c*) is located on a side of the additional bearing-portion oil-supply passage (60) at a third interface portion between the drive shaft (17) and the additional bearing (32) and the fourth sealing portion (65*d*) being located on an opposite side of the additional bearing-portion oil-supply passage (60) in the axial direction at a fourth interface portion between the drive shaft (17) and the same additional bearing (32). (see FIGS. 2 and 3).

The sealing portions (65) are constituted by controlling the outer peripheral face of the drive shaft (17) and the inner peripheral face of the bearing (32,34,45) so accurately, for example, such as at a micron order that there exists substantially no gap between them. Accordingly, the gas refrigerant flowing into the sliding faces between the drive shaft (17) and the bearing (34,32,45) can be prevented at the both ends in the axis direction of the bearings (32,34,45). Particularly, even during the starting operation and the like, where stable flowing of the refrigerating machine oil from the oil reservoir (48) to the bearings (32,34,45) may not yet exist, the gas refrigerant with high pressure can be prevented from flowing in spaces between the drive shaft (17) and the bearings (34,32,45).

Herein, the sealing portions (65) may be constituted, for example, by installing a distinct seal member, instead of forming the outer peripheral surface of the drive shaft (17) and the inner peripheral faces of the bearings (32,34,45) with substantially no gaps between them. Namely, it should be any structure in which no gas refrigerant flows into the sliding face.

Figure 2:
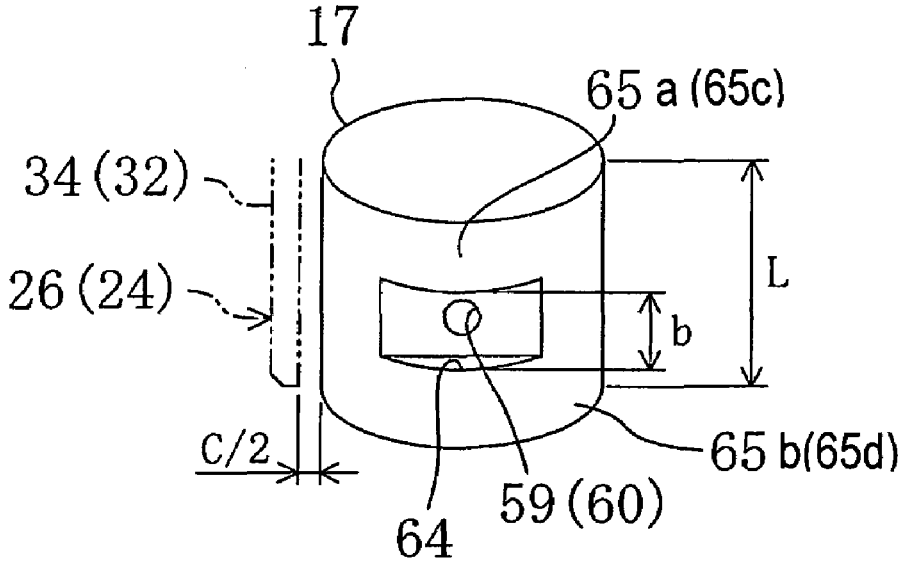
FIG. 2 is a partial perspective view of a drive shaft for showing an oil supply groove in the present embodiment.

In the meantime, as shown in FIG. 2, the drive shaft (17) has an oil supply groove (64) that is formed at the sliding face constituted between the upper-second bearing (34) and the upper-first bearing (32). The oil supply groove (64) is formed in a flat-face shape, by cutting away part of the outer peripheral face of the drive shaft (17). The oil supply groove (64) is formed at each of the sliding faces between the drive shaft (17) and the upper-first and second bearings (32,34) and is located between the first and second sealing portions (65*a*,65*b*) disposed on either side of the bearing-portion oil-supply passages (59,60) in the axis direction, and the oil supply groove (64) is connected to the bearing-portion oil-supply passages (59,60). The oil supply groove (64) is formed in a rectangular shape in such manner that it has a longer side in the circumferential direction of the drive shaft (17) and an opening end of each of the bearing-portion oil-supply passages (59,60) is enlarged in the axis direction and the circumferential direction of the drive shaft (17). The oil-supply groove (64) has a length in a circumferential direction of the drive shaft (17) longer than a length of the oil-supply groove (64) in an axial direction of the drive shaft (17).

Figure 3:
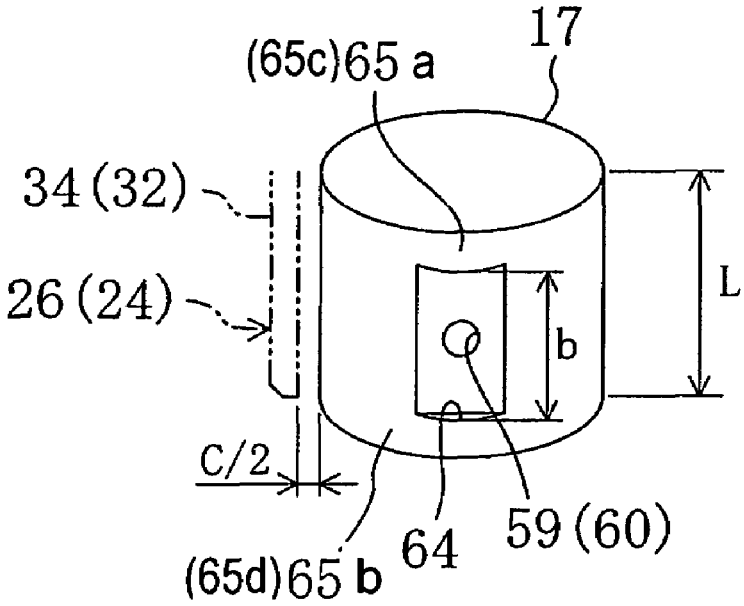
FIG. 3 is a partial perspective view of a drive shaft for showing another embodiment of the oil supply groove.

Herein, the oil supply groove (64) may be formed, as shown in FIG. 3, in a rectangular shape in such manner that it has a longer side in the axis direction of the drive shaft (17). Further, it is not necessary to form the oil supply groove (64) in the rectangular shape. Its shape can be changed properly like a circular shape or a spiral-groove shape, as long as the sealing portions (65) are formed at the both end portions. Further, the oil supply groove (64) may be formed at the sliding face at the side of the bearings (32,34), instead of at the side of the drive shaft (17).

It is preferred that the oil supply groove (64) is constituted in such manner that a length: L of the bearings (32,34) in the axis direction, a gap distance: C between the inside diameter of the bearings (32,34) and the outside diameter of the drive shaft (17), and a length: b of the oil supply groove (64) in the axis direction are provided so as to satisfy the following equations (1), (2):

$$((L-b)/C)\times10^{-3}>0.2 \quad (1)$$

$$b/L>0.3 \quad (2).$$

Figure 4:
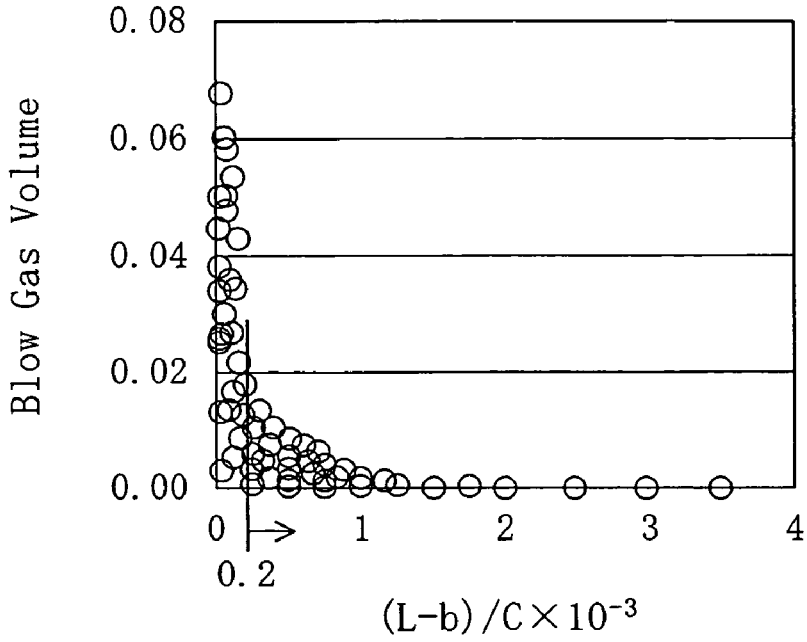
FIG. 4 is a characteristic diagram for showing a relationship between an index value of sealing function and the volume of a blow gas.

The value of the equation (1): $((L-b)/C)\times10^{-3}$ indicates a ratio of a length in the axis direction of the sealing portion (65) to a width of the gap between the drive shaft (17) and the upper bearings (32,34), which is an index value for representing the sealing function. FIG. 4 shows a relationship between the index value of the sealing function and the volume of blow gas (unit: gram/sec) that is the volume of the gas refrigerant flowing in. It can be understood clearly from this figure that when the length in the axis direction of the sealing portion (65) is short compared to the gap of the sliding face and thereby the index value is 0.2 or less, a flow resistance of the sealing portion (65) becomes small and thereby the blow gas volume increases sharply and the sealing function deteriorates. Further, the pressure differential between high-level pressure and low-level pressure for the pressure-differential pump becomes small, thereby deteriorating the oil-supply function as well.

The relationship shown in FIG. 4 shows an example of analysis results obtained by variously changing, some parameters, such as inside diameter of bearing, length of bearing, gap of bearing, load of bearing, rotational speed and the like. It can be understood from this figure that when the index value is over 0.2, occurrence of the blow gas is suppressed and thereby the sealing function can be performed effectively regardless of changing the parameters. Accordingly, forming the oil supply groove (64) by using the index vale can provide the sealing function effectively and also maintain the sufficient oil-supply function by the pressure-differential pump.

Figure 5:
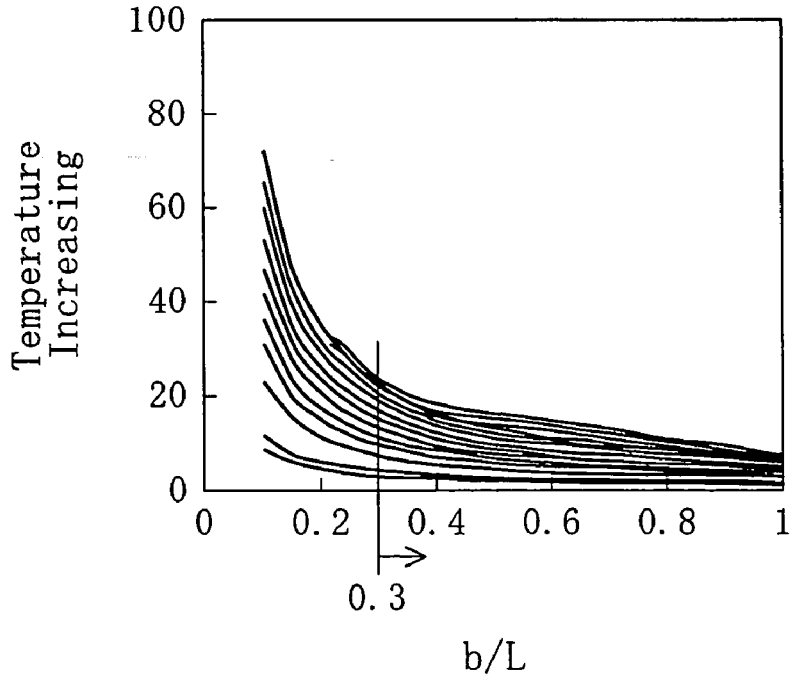
FIG. 5 is a characteristic diagram for showing a relationship between a ratio: b/L of length in the axis direction of the oil supply groove to the one of a bearing, and temperature increasing of the bearing.

FIG. 5 shows a relationship between a ratio represented by b/L and temperature increasing of the upper bearings (34,32). It can be understood clearly from this figure that when the value of b/L is 0.3 or less, the temperature of the upper bearings (34,32) increases sharply. The relationship shown in FIG. 5 shows an example of analysis results obtained by variously changing some parameters, such as inside diameter of bearing, length of bearing, gap of bearing, load of bearing, rotational speed, viscosity of oil and the like. It can be understood from this figure that when the value of b/L is over 0.3, the temperature increasing of the upper bearings (34,32) can be suppressed regardless of changing the parameters. Accordingly, setting the value of b/L in the above range can prevent the durability of the upper bearings (34,32) from deteriorating. Herein, the value of temperature increasing for each parameter is shown in relative-value form, in which the temperature increasing without the oil supply groove (64) is set at a value of 100.

It can be understood from the above that the smaller the oil supply groove (64) compared to the sealing portion (65) is, the more the sealing function improves, whereas the bigger the oil supply groove (64) is, the more the temperature increasing is suppressed. Accordingly, it is preferred that the dimensions of the oil supply groove (64) is set so as to satisfy both of the above equations (1) and (2). For this, the following equation (3), which is obtained by substituting the equation (2) for the equation (1), should be satisfied:

$$0.3L<b<L-0.2C\times10^3 \quad (3).$$

Also, the oil supply groove (64) that is constituted like the above can maintain the oil-supply function, performing the sealing function effectively, and also suppress the temperature increasing of the upper bearings (34,32).

Figure 6:
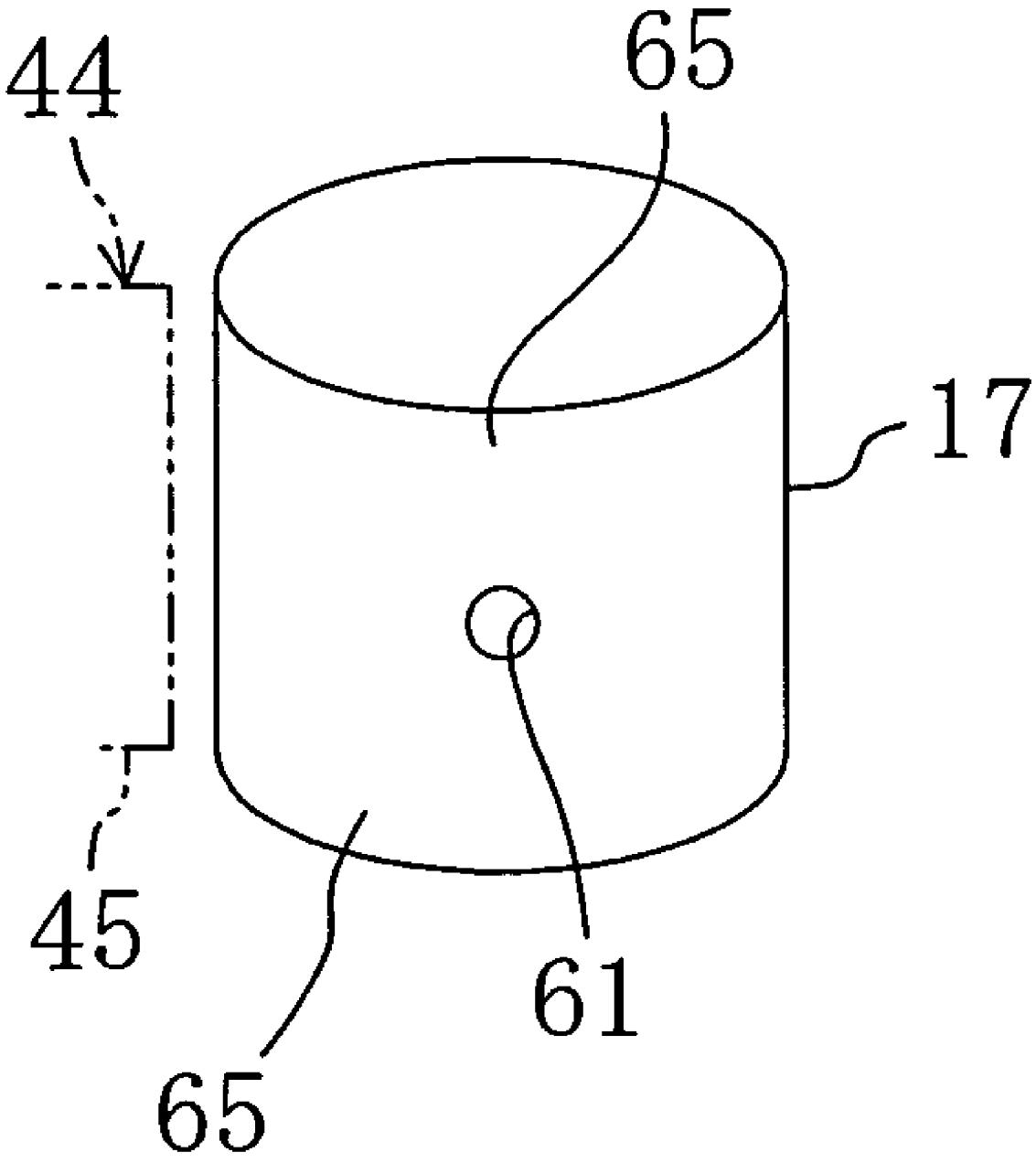
FIG. 6 is a partial perspective view of the drive shaft for showing a flowing-out end of a third bearing-portion oil-supply passage in the present embodiment.

On the other hand, the third bearing-portion oil-supply passage (61), as shown in FIG. 6, opens at the outer peripheral face of the drive shaft (17) without an enlarged cross section of its flowing-out end. Namely, no oil supply groove is provided at this portion. Part of the lower frame (44) is put in the oil of the oil reservoir (48) and most of the refrigerant machine oil in the casing (10) returns to the oil reservoir (48) particularly during the starting operation, and thereby the oil level rises. This brings a state where the oil in the oil reservoir (48) flows in easily between the drive shaft (17) and the lower bearing (45). Accordingly, enough amount of oil supplying to the lower bearing (45) can be obtained without forming any oil supply groove at the flowing-out end of the third bearing-portion oil-supply passage (61).

During the operation of the compressor (1), the refrigerating machine oil in the oil reservoir (48) that is located in high-pressure space flows into the main oil-supply passage (51) in the drive shaft (17). Then, part of the oil flowing into the main oil-supply passage (51) flows into the bearing-portion oil-supply passages (59,60,61) by the pressure-differential pump and the centrifugal pump. The rest of the oil flows into the scroll-portion oil-supply passage (53) through the main oil-supply passage (51), and then it is supplied to the sliding surface between the scrolls (22,26) that leads to the low-pressure space.

The oil flowing into the bearing-portion oil-supply passages (59,60,61) is supplied to the sliding faces between the drive shaft (17) and the bearings (32,34,45) from respective opening ends at the outer peripheral faces of the driving shaft (17). Further, because the sealing portions (65) are formed at the both sides in the axis direction of each of the bearing-portion oil-supply passages (59,60,61), even, for example, during the starting operation and the like, where stable discharging of the oil from the gaps between the drive shaft (17) and the bearings (32,34,45) does not yet exist, the gas refrigerant can be prevented from flowing in the sliding faces from the side of both ends of the bearings (32,34,45), thereby maintaining the lubrication of the bearings (32,34, 45). Accordingly, because the excessive increasing of temperature of the bearings (32,34,45) can be prevented, the deterioration of durability of the bearings (32,34,45) can be prevented and also seizure of the drive shaft (17) can be prevented.

Particularly, because the oil supply groove (64) is formed at each of sliding faces between the drive shaft (17) and the upper bearings (32,34) that are disposed at the frame (24) and the orbiting scroll (26), enough amount of refrigerating machine oil can be supplied to the upper bearings (32,34).

Further, by forming the oil supply groove (64) in such manner that the sliding length: L in the axis direction between the drive shaft (17) and the upper bearings (32,34), the differential: C between the inside diameter of bearing and the outside diameter of the drive-shaft sliding portion, and the length: b in the axis direction of the oil supply groove (64) satisfy the equation (3): $0.3L<b<L-0.2C\times10^3$, sufficient oil-supply performance can be obtained by preventing the gas refrigerant from flowing in the upper bearings (32,34) certainly, and the temperature increasing of the upper bearings (32,34) can be suppressed certainly.

Meanwhile, although no oil supply groove is formed at the sliding face between the drive shaft (17) and the lower bearing (45), the oil in the oil reservoir (48) can be supplied to the sliding face at this portion from the gap between the drive shaft (17) and the lower bearing (45). Particularly, during the starting operation the oil in the casing (10) returns to the oil reservoir (48), thereby increasing the oil volume, and therefore the oil in the oil reservoir (48) can be utilized certainly. Accordingly, this can maintain enough amount of oil supplying to the lower bearing (45) with simple structure.

Further, because the restriction (56) is provided in the scroll-portion oil-supply passage (53) connecting with the sliding surface between the scrolls (22,26), even though a small gap occurs at the sliding surface between the both scrolls (22,26) when the orbiting scroll inclines (overturn) during the revolution, the restriction function of the scroll-portion oil-supply passage (53) can prevent the oil from leaking out. Accordingly, pressure decreasing in the main oil-supply passage (51) can be suppressed. As a result, even though the orbiting scroll (26) overturns, oil supplying from the bearing-portion oil-supply passages (59,60,61) to the bearings (32,34,45) can be achieved certainly.

OTHER EMBODIMENTS

In the above-described embodiment, the scroll compressor (1) makes use of the pressure-differential pump by pressure differential between high-level pressure and low-level pressure that exists between the oil reservoir (48) and the sliding face of the scrolls (22,26). However, the low-pressure side should not be necessarily connected with the sliding face of the scrolls (22,26). Namely, oil supplying to the sliding face of the scrolls (22,26) is not an essential structure in the present invention. Accordingly, the present invention is applicable to other rotary compressor than the scroll compressor.

Further, the oil supply groove (64) of the first bearing-portion oil-supply passage (59) and the second bearing-portion oil-supply passage (60) may be omitted in the above embodiment. Particularly, for example, in the case where the sliding length: L in the axis direction of the upper bearings (32,34) is so short that only bearing-portion oil-supply passages (59,60) can maintain enough amount of oil supplying to the bearings (32,34), the oil supply groove (64) may be preferably omitted to simplify the structure. Conversely, although no oil supply groove is provided at the lower bearing (61) in the above embodiment, the oil supply groove (64) may be provided at all bearings (59,60,61) including the lower bearing (61). According to this structure, enough amount of oil supplying can be maintained for all bearings (59,60,61) with high sealing function, thereby improving the reliability of bearing more.

Further, the number or the place of the bearings (32,34,45) to be positioned in the casing is a matter of design choice, so that it should not be limited to the one in the above embodiment, but determined based on a specific structure of the compressor. For example, the lower bearing is not necessary in a certain case.

Further, although the above embodiment adopts both of the pressure-differential pump and the centrifugal pump (49), a mechanical pump such as the centrifugal pump (49) is not necessarily used. Also, although the main oil-supply passage (51) is formed at a position such that it is eccentric from the axis of the drive shaft (17) in the above embodiment, it may be positioned so as to fit the axis of the drive shaft (17) instead.

Further, although so-called high-pressure dome-type compressor, in which the casing (10) is filled with the discharged gas refrigerant, is described in the above embodiment, so-called high-low pressure dome-type compressor, in which the casing (10) is divided into high-pressure space and low-pressure space, may be adopted. In this case, however, it may be necessary that the oil reservoir (48) and the bearings (32,34,45) are disposed in the high-pressure space.

INDUSTRIAL APPLICABILITY

As described above, the present invention is useful for the rotary compressor.

What is claimed is:

1. A rotary compressor comprising:

a casing including high-pressure and low-pressure spaces;

a compressing mechanism;

at least one bearing disposed in the high-pressure space in the casing, the bearing having an inner peripheral face;

an oil reservoir having an inside pressure that increases during operation with the low-pressure space; and a compressor motor with a drive shaft driving the compressing mechanism, the drive shaft being supported by the bearing, the drive shaft having an outer peripheral face, the drive shaft further having a main oil-supply passage and at least one bearing-portion oil-supply passage formed in the drive shaft, the main oil-supply passage connecting the oil reservoir, one end of the bearing-portion oil-supply passage being connected with the main oil-supply passage and another end of the bearing-portion oil-supply passage being connected with a sliding face constituted between the drive shaft and the bearing, the outer peripheral face of the drive shaft and the inner peripheral face of the bearing forming first and second sealing portions having substantially air-tight structures, the first sealing portion being located on a side of the bearing-portion oil-supply passage at a first interface portion between the drive shaft and the bearing and the second sealing portion being located on an opposite side of the bearing-portion oil-supply passage in an axial direction of the sliding face at a second interface portion between the drive shaft and the same bearing, at least one of the drive shaft and the bearing including an oil-supply groove connected to the bearing-portion oil-supply passage, the oil-supply groove being formed at the sliding face and located between the first and second sealing portions, and the oil-supply groove having a length in a circumferential direction of the drive shaft longer than a length of the oil-supply groove in an axial direction of the drive shaft.

2. The rotary compressor of claim 1, wherein the compressing mechanism includes a fixed scroll that is fixed in the casing and an orbiting scroll that revolves orbitally relative to the fixed scroll, the orbiting scroll includes a scroll-portion oil-supply passage that is formed so as to be connected from the main oil-supply passage of the drive shaft through a sliding surface constituted between the fixed scroll and the orbiting scroll to the low-pressure space that is located at a suction side of the compressing mechanism.

3. The rotary compressor of claim 2, wherein at least part of the scroll-portion oil-supply passage is constituted of a restriction pathway.

4. The rotary compressor of claim 1, wherein the drive shaft is disposed so as to extend in a vertical direction in the casing, the at least one bearing includes a lower bearing that is close to the oil reservoir and an upper bearing that is located above the lower bearing, and the oil supply groove is disposed at least at the upper bearing.

5. The rotary compressor of claim 1, wherein the drive shaft includes an additional bearing-portion oil-supply passage with an additional bearing having an inner peripheral face disposed about the outer peripheral face of the drive shaft such that the inner peripheral face of the additional bearing and the outer peripheral face of the drive shaft form third and fourth sealing portions having substantially air-tight structures, the third sealing portion being located on a side of the additional bearing-portion oil-supply passage at a third interface portion between the drive shaft and the additional bearing and the fourth sealing portion being located on an opposite side of the additional bearing-portion oil-supply passage in the axial direction at a fourth interface portion between the drive shaft and the same additional bearing.

6. A rotary compressor comprising:

a casing including high-pressure and low-pressure spaces;

a compressing mechanism;

at least one bearing disposed in the high-pressure space in the casing, the bearing having an inner peripheral face;

an oil reservoir having an inside pressure that increases during operation with the low-pressure space; and a compressor motor with a drive shaft driving the compressing mechanism, the drive shaft being supported by the bearing, the drive shaft having an outer peripheral face, the drive shaft further having a main oil-supply passage and at least one bearing-portion oil-supply passage formed in the drive shaft, the main oil-supply passage connecting the oil reservoir, one end of the bearing-portion oil-supply passage being connected with the main-oil supply passage and another end of the bearing-portion oil-supply passage being connected with a sliding face constituted between the drive shaft and the bearing, the outer peripheral face of the drive shaft and the inner peripheral face of the bearing forming first and second sealing portions having substantially air-tight structures, the first sealing portion being located on a side of the bearing-portion oil-supply passage at a first interface portion between the drive shaft and the bearing and the second sealing portion being located on an opposite side of the bearing-portion oil-supply passage in an axial direction of the sliding face at a second interface portion between the drive shaft and the same bearing, at least one of the drive shaft and the bearing including an oil-supply groove connected to the bearing-portion oil-supply passage, the oil-supply groove being formed at the sliding face and located between the first and second sealing portions, and a length L of the bearing in the axis direction, a gap distance C between an inside diameter of the bearing and an outside diameter of the drive shaft at the sliding face, and a length b of the oil groove in the axis direction being provided such that $0.3L<b<L-0.2C\times 10^3$.

7. The rotary compressor of claim 6, wherein the compressing mechanism includes a fixed scroll that is fixed in the casing and an orbiting scroll that revolves orbitally relative to the fixed scroll, the orbiting scroll includes a scroll-portion oil-supply passage that is formed so as to be connected from the main oil-supply passage of the drive shaft through a sliding surface constituted between the fixed scroll and the orbiting scroll to the low-pressure space that is located at a suction side of the compressing mechanism.

8. The rotary compressor of claim 7, wherein at least part of the scroll-portion oil-supply passage is constituted of a restriction pathway.

9. A rotary compressor comprising:

a casing including high-pressure and low-pressure spaces;

a compressing mechanism;

at least one bearing disposed in the high-pressure space in the casing, the bearing having an inner peripheral face;

an oil reservoir having an inside pressure that increases during operation with the low-pressure space; and a compressor motor with a drive shaft driving the compressing mechanism, the drive shaft being supported by the bearing, the drive shaft having an outer peripheral face, the drive shaft further having a main oil-supply passage and at least one bearing-portion oil-supply passage formed in the drive shaft, the main oil-supply passage connecting the oil reservoir, one end of the bearing-portion oil-supply passage being connected with the main oil-supply passage and another end of the bearing-portion oil-supply passage being connected with a sliding face constituted between the drive shaft and the bearing, the outer peripheral face of the drive shaft and the inner peripheral face of the bearing forming first and second sealing portions having substantially air-tight structures, the first sealing portion being located on a side of the bearing-portion oil-supply passage at a first interface portion between the drive shaft and the bearing and the second sealing portion being located on an opposite side of the bearing-portion oil-supply passage in an axial direction of the sliding face at a second interface portion between the drive shaft and the bearing, and at least one of the drive shaft and the bearing including an oil supply groove, a length b of the oil supply groove in the axis direction, a length L of the bearing in the axis direction and a gap distance C between an inside diameter of the bearing and an outside diameter of the drive shaft at the sliding face being provided such that $0.3L<b<L-0.2C\times10^3$.

10. A rotary compressor comprising:

a casing including high-pressure and low-pressure spaces;

a compressing mechanism;

at least one bearing disposed in the high-pressure space in the casing, the bearing having an inner peripheral face;

an oil reservoir having an inside pressure that increases during operation with the low-pressure space; and a compressor motor with a drive shaft driving the compressing mechanism, the drive shaft being supported by the bearing, the drive shaft having an outer peripheral face, the drive shaft further having a main oil-supply passage and at least one bearing-portion oil-supply passage formed in the drive shaft, the main oil-supply passage connecting the oil reservoir, one end of the bearing-portion oil-supply passage being connected with the main oil-supply passage and another end of the bearing-portion oil-supply passage being connected with a sliding face constituted between the drive shaft and the bearing, the outer peripheral face of the drive shaft and the inner peripheral face of the bearing forming first and second sealing portions having substantially air-tight structures, the first sealing portion being located on a side of the bearing-portion oil-supply passage at a first interface portion between the drive shaft and the bearing and the second sealing portion being located on an opposite side of the bearing-portion oil-supply passage in an axial direction of the sliding face at a second interface portion between the drive shaft and the same bearing, at least one of the drive shaft and the bearing including an oil-supply groove connected to the bearing-portion oil-supply passage, the oil-supply groove being formed at the sliding face and located between the first and second sealing portions, and the oil-supply groove having a rectangular shape and being flat-faced.

11. The rotary compressor of claim 10, wherein the drive shaft is disposed so as to extend in a vertical direction in the casing, the at least one bearing includes a lower bearing that is close to the oil reservoir and an upper bearing that is located above the lower bearing, and the oil supply groove is disposed at least at the upper bearing.

12. The rotary compressor of claim 10, wherein the compressing mechanism includes a fixed scroll that is fixed in the casing and an orbiting scroll that revolves orbitally relative to the fixed scroll, the orbiting scroll includes a scroll-portion oil-supply passage that is formed so as to be connected from the main oil-supply passage of the drive shaft through a sliding surface constituted between the fixed scroll and the orbiting scroll to the low-pressure space that is located at a suction side of the compressing mechanism.

13. The rotary compressor of claim 10, wherein at least part of the scroll-portion oil-supply passage is constituted of a restriction pathway.

* * * * *

UNITED STATES PATENT AND TRADEMARK OFFICE

CERTIFICATE OF CORRECTION

PATENT NO. : 7,322,809 B2
APPLICATION NO. : 10/490164
DATED : January 29, 2008
INVENTOR(S) : Hiroshi Kitaura et al.

It is certified that error appears in the above-identified patent and that said Letters Patent is hereby corrected as shown below:

On the title page change the listing of [75] Inventors from

"[75] Inventors: Hiroshi Kitaura, Sakai (JP); Hiroyuki Yamaji, Sakai (JP); Masanori Yanagisawa, Sakai (JP)"

to

-- [75] Inventors: Hiroshi Kitaura, Sakai (JP); Hiroyuki Yamaji, Sakai (JP); Masanori Yanagisawa, Sakai (JP); Takashi Uekawa, Sakai (JP) --

UNITED STATES PATENT AND TRADEMARK OFFICE

CERTIFICATE OF CORRECTION

PATENT NO. : 7,322,809 B2
APPLICATION NO. : 10/490164
DATED : January 29, 2008
INVENTOR(S) : Hiroshi Kitaura et al.

It is certified that error appears in the above-identified patent and that said Letters Patent is hereby corrected as shown below:

On the second title page, item (56) change the listing of FOREIGN PATENT DOCUMENTS from "FOREIGN PATENT DOCUMENTS JP 2000-27782 A 1/2000
JP 2001-041162 A 2/2001
JP 10-236486 A 09/1998
JP 10-288178 A 10/1998
JP 11/22665 1/1999"

to

-- FOREIGN PATENT DOCUMENTS JP 2000-27782 A 1/2000
JP 2001-041162 A 2/2001
JP 10-238486 A 09/1998
JP 10-288178 A 10/1998
JP 11/22665 1/1999 --

Signed and Sealed this

Twenty-seventh Day of May, 2008

JON W. DUDAS
*Director of the United States Patent and Trademark Office*